US006047528A

United States Patent [19]

Scholin et al.

[11] Patent Number: 6,047,528

[45] Date of Patent: Apr. 11, 2000

[54] METHOD AND APPARATUS FOR CONTINUOUSLY FORMING SEALED POUCHES WHILE LINKED TOGETHER

[75] Inventors: Claude W. Scholin, Naperville; William N. Pearson, Highland Park; Daniel A. Czolek, Chicago; Jeffrey A. Rice, Elmhurst, all of Ill.

[73] Assignee: Cloud Corporation, Des Plaines, Ill.

[21] Appl. No.: 09/207,775

[22] Filed: Dec. 9, 1998

[51] Int. Cl.[7] ..... B65B 9/08; B65B 51/16; B65B 51/20; B65B 51/26

[52] U.S. Cl. ..... 53/455; 53/77; 53/373.9; 53/374.4; 53/562

[58] Field of Search ..... 53/455, 562, 374.4, 53/374.3, 373.7, 373.9, 77; 493/197, 196, 195, 194, 193, 208

[56] References Cited

U.S. PATENT DOCUMENTS

| | | | |
|---|---|---|---|
| 3,453,799 | 7/1969 | Cloud et al. | 53/455 |
| 3,505,778 | 4/1970 | Cloud et al. . | |
| 3,589,091 | 6/1971 | Cloud . | |
| 3,597,898 | 8/1971 | Cloud | 53/455 |
| 3,618,286 | 11/1971 | Membrino | 53/373.4 X |
| 4,232,504 | 11/1980 | Dieterlen et al. | 53/562 X |
| 5,060,450 | 10/1991 | Greenwell et al. | 53/562 X |
| 5,134,833 | 8/1992 | Lerner et al. | 53/373.9 X |
| 5,359,832 | 11/1994 | Hartman et al. | 53/562 X |
| 5,699,653 | 12/1997 | Hartman et al. | 53/455 |

*Primary Examiner*—James F. Coan
*Attorney, Agent, or Firm*—Meroni & Meroni; Charles F. Meroni, Jr.

[57] ABSTRACT

A method and apparatus for packaging powder material includes feeding a continuous web of V-shaped heat sealable material to a first forming station to form longitudinally spaced upright seals to provide longitudinally spaced upwardly opening pouches. The pouches are filled with powder material at a filling station and then pulled through a downwardly curving path while the bottoms of the pouches are supported. The upper portions of the pouches are heated along the downwardly curving path and then snapped shut and pressed together to form a top seal with a set of nip rollers positioned at a lower portion of the downwardly curving path. Sealed pouches are then severed from the continuous web to form separate packages.

44 Claims, 5 Drawing Sheets

METHOD AND APPARATUS FOR CONTINUOUSLY FORMING SEALED POUCHES WHILE LINKED TOGETHER

BACKGROUND OF THE INVENTION

1. Field of the Invention

The present invention relates generally to packaging machines. More particularly, the invention pertains to an improved method and apparatus for handling filled but open pouches until they are sealed.

2. Description of the Prior Art

Various prior art packaging machines are known in the art. Packaging machines are often categorized into horizontal and vertical machines depending on the general direction of movement of a continuous web of material. Further, packaging machines are typically designed to operate in either a continuous or intermittent manner.

In the packaging of powder materials, such as finely powdered food product, horizontal intermittently operated packaging machines are known for packaging at rates of approximately 150 packages per minute. In this process, lead packages are first severed from a web of material and then filled and top sealed using intermittently controlled packaging equipment. Unfortunately, this process is unable to package at faster more desirable rates. Still other similar processes are known that require package bottoms to have gussets to allow the package to sufficiently hold a required amount of powder material during the packaging process without the powder material discharging or overflowing from the package. These gusseted packages are more expensive to produce than conventional packages, due to the same speed constraints.

Accordingly, it is desirable to improve the packaging of powder materials by using a horizontal continuously operating packaging machine and process that can package at a faster rate than intermittently operated machines.

As will be described in greater detail hereinafter, the method and apparatus of the present invention solves the aforementioned and employs a number of novel features that render it highly advantageous over the prior art.

SUMMARY OF THE INVENTION

Accordingly, it is an object of this invention to provide a method and apparatus for continuously forming, filling, and sealing pouches filled with powder material while the pouches are linked together.

Another object of this invention is to provide a method and apparatus that uses a continuous web of heat sealable film material and provides controlled web tension through a top sealing apparatus without creating tension prior to sealing.

Still another object of this invention is to provide a method and apparatus that can form packages at a rate of from 300 to 2,500 packages per minute depending on repeat and product flowability with each package having the same size and weight.

Yet another object of this invention is to provide a method and apparatus for packaging fine powder materials, such as finely powered food product, in continuous manner that does not disrupt the package causing the powder materials to become expelled from the package before the package is completely enclosed.

To achieve the foregoing and other objectives, and in accordance with the purposes of the present invention a packaging machine is provided having a continuous web of heat sealable material. The machine includes a top seal forming apparatus for a forming top seals on the continuous web of filled open topped linked pouches. The top seal forming apparatus moves the continuous web along a downwardly, arcuately shaped path. A first set of nip rollers are positioned at an upper portion of the downwardly, arcuately shaped path. The first set of nip rollers are adapted for operatively engaging an upper portion of the continuous web. A web heating unit is positioned downstream from the first set of nip rollers adjacent to the downwardly, arcuately shaped path for heating the upper portion of the continuous web. A second set of nip rollers are positioned at a lower portion of the downwardly, arcuately shaped path downstream from said web heating unit for pulling the continuous web and pinching the upper portions of the continuous web to form a top seal to enclose each of the linked pouches.

In accordance with an aspect of the invention, a pouch support surface is provided for supporting the bottom portion of continuous web during a substantial portion as it is moved along the downwardly, arcuately shaped path.

In accordance with another aspect of the invention, the second set of nip rollers is operated at speed greater than the first set of nip rollers causing the open topped linked pouches to remain partially open until entry into the second fee nip.

In accordance with a method of the invention, a method of packaging powder material is provided comprising the steps of: continuously feeding a V-shaped web of heat sealable packaging material to a first forming station; forming longitudinally spaced upright seals at the first forming station to provide longitudinally spaced upwardly opening pouches, thereafter consecutively filling the pouches on the V-shaped web with powder material at a filling station using a first set of powered nip rollers to pull the V-shaped web from the filling station; pulling the linked filled pouches with a second set of powered nip rollers operating at a speed slightly greater than the first pair of powered nip rollers through a downwardly curving path to lengthen the width of the upper ends of each filled pouch while dragging the filled pouch along a curved pouch support surface engaged with a bottom end of each pouch, pulling shut the open ends of the filled pouches, heat sealing an upper open end of each filled pouch to form a continuous linked strip of powder filled sealed packages; and successively severing each leading powder filled sealed package from the continuous linked strip of powder filled sealed packages to free the sealed powder filled packages from the strip.

Other objects, features and advantages of the invention will become more readily apparent upon reference to the following description when taken in conjunction with the accompanying drawings, which drawings illustrate several embodiments of the invention.

DETAILED DESCRIPTION OF THE PREFERRED EMBODIMENT

The present invention relates to a horizontal packaging machine and is designed to operate in a continuous manner utilizing a continuous web of heat sealable material. In the following description, numerous specific details are set forth in order to provide a thorough understanding of the present invention. It will be obvious, however, to one skilled in the art that the present invention may be practiced without these specific details. In other instances, well-known circuits, structure and techniques have not been shown in detail in order not to unnecessarily obscure the present invention.

Figure 1:
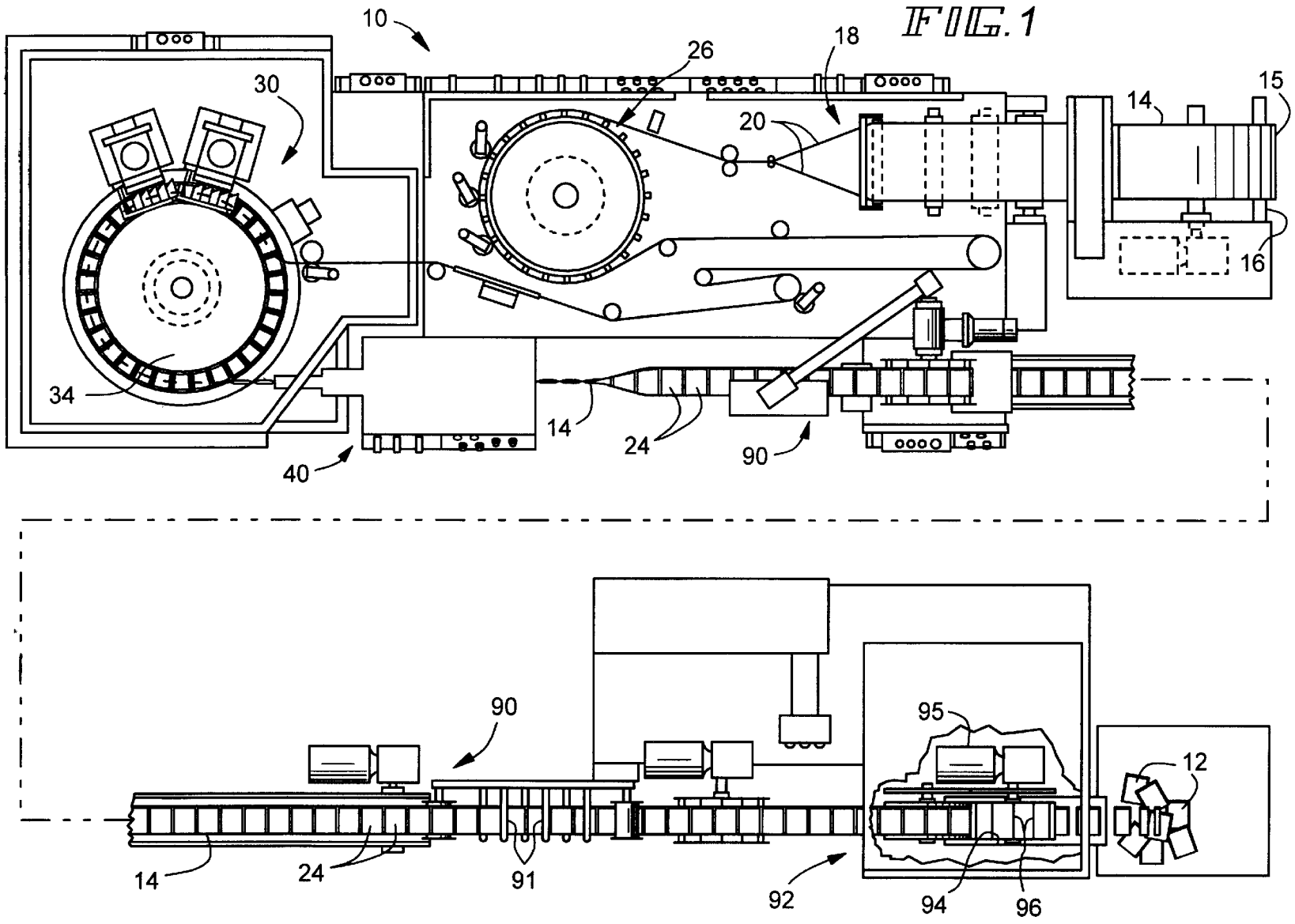
FIG. 1 is a top plan view of a packaging machine of the present invention.

Referring now to the drawing, a packaging machine 10 is illustrated in FIG. 1. The packaging machine 10 is capable of producing packages 12 at a high rate of production. In the embodiment described herein, the packaging machine 10 is capable of producing packages 12 at a rate of at least 600 packages per minute where each package 12 is of the same size and weight. The packages 12 are produced from a continuous strip or web 14 of heat sealable film material or from several continuous webs of film material as desired. In a preferred embodiment, the continuous laminated web 14 contains a heat sealable polymer sealant, such as polyethylene, that is provided in a coiled roll 15 that is mounted for rotation on a frame 16. A suitable strip plow 18 of conventional design is provided for folding the web 14 to provide a V-shaped strip having confronting sides 20 joined along a bottom edge 22 (FIG. 2) of the web 14.

Figure 2:
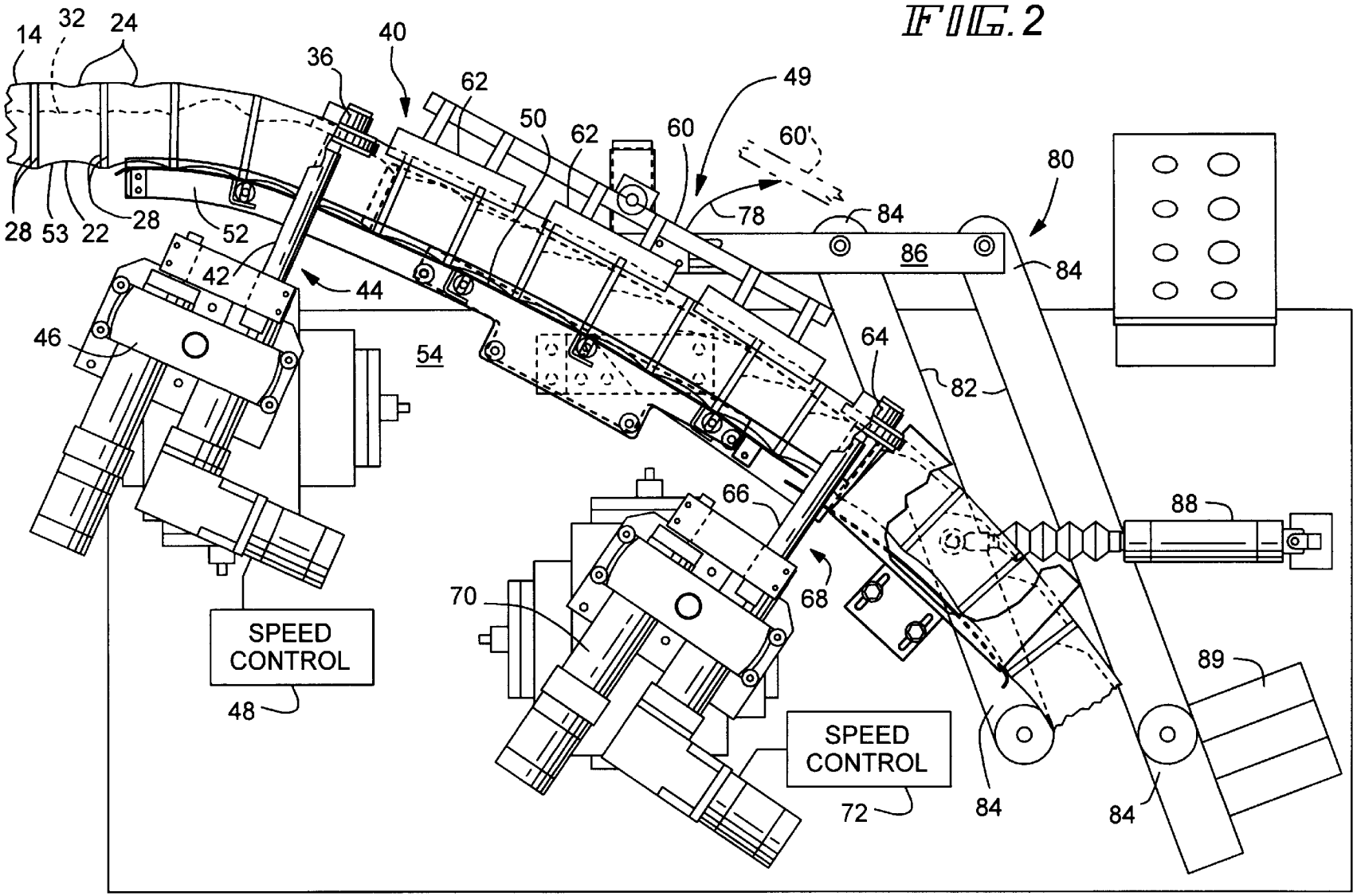
FIG. 2 is an elevated view of a top sealer apparatus of the present invention.

Referring to FIGS. 1 and 2, pouches 24 are formed at a first forming station 26 (FIG. 1) that forms longitudinally spaced upright seals 28 to provide longitudinally spaced upwardly opening pouches. The first forming station 26 is of known design such as that disclosed in U.S. Pat. No. 5,722,217 assigned to the Cloud Corporation, the assignee of the present application. Thereafter, the pouches 24 are consecutively filled at a filling station 30 that provides a predetermined amount of material, such as powder material 32 (identified by the dotted line at an upper end of each of the linked pouches 24), into each consecutive pouch 24. The powder material may be finely powdered food or non-food product. In a preferred embodiment, a filling wheel 34 of the filling station 30 uses a conventional volumetric filling technique. The web 14 is pulled from the filling station with an upper or first set of powered nip rollers 36 (FIG. 11), which are described later in more detail. As the web 14 leaves the filling wheel 34, the pouches 24 are full, and the top seal area is wide open, as illustrated in FIG. 11 by opening 38.

Figure 11:
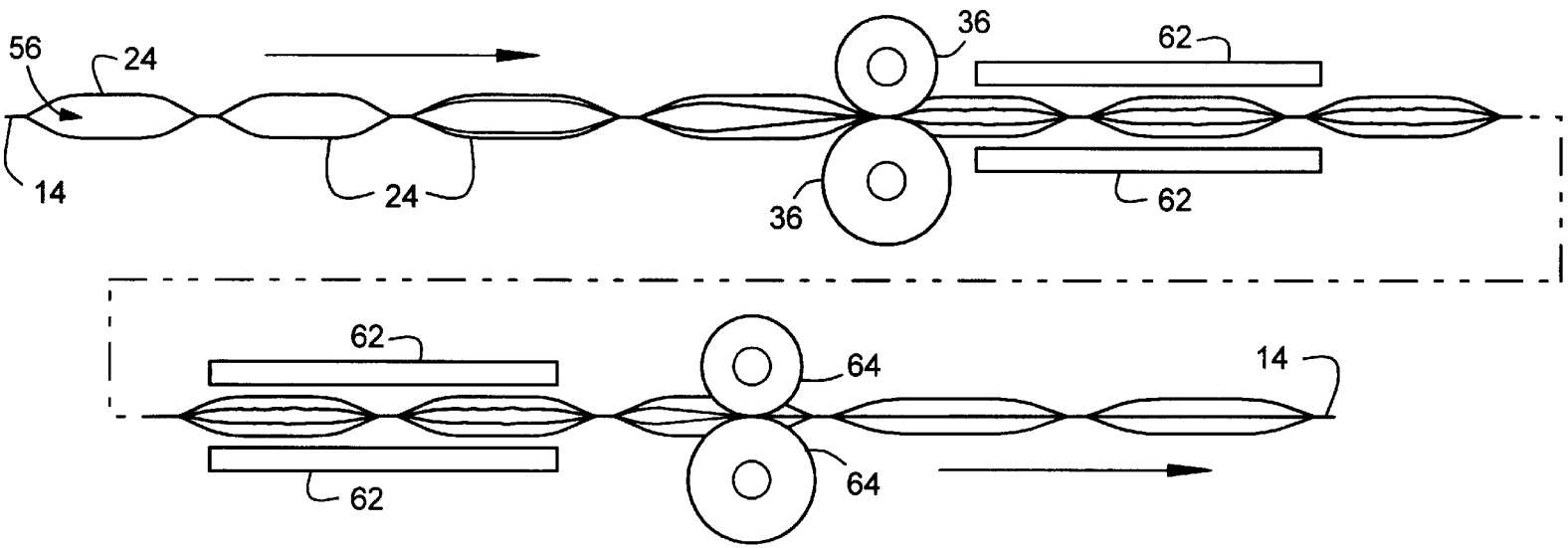
FIG. 11 is a diagrammatic view of the flow of a continuous web of filled pouches through the top sealer apparatus.

Referring to FIGS. 2 and 11, the web enters a top seal forming apparatus or top sealer mechanism 40 and is pulled from the filler wheel 34, as previously described, in a controlled manner by the first set of nip rollers 36 mounted to the ends of shafts 42 of the first spindle assembly 44. The spindles are mounted below the nip or pinch rollers 36 to allow for easy threading of the web 14 between the rollers 36. The pattern used on the face of the nip rollers will vary on the web 14 material used, web speed and the type of fill. The shafts 42 are connected to a spindle drive 46 which is a conventional servo motor that has a speed control 48 that can be independently controlled by a user. In the preferred embodiment shown, the servo motor is set to track the filler wheel so that the web tension can be controlled.

As the web 14 is pulled from the filler wheel 34, the pouches 24 must be closed without disturbing or spilling product in the pouch 24. In accordance with our invention, this is accomplished by pulling the pouches 24 downwardly in an arcuately or curved path 49 across a curved pouch support surface 50. The amount of arc is determined by the arc that a full web will naturally form when the top seals are pulled tight and the bottom 53 is undisturbed. Since this arc changes from one type of pouch to another, as well as one fill to another, the pouch support surface 50 (FIG. 3) is mounted to adjustable brackets 52 that are connected to a frame 54 of the apparatus 40 to facilitate this adjustment.

Figure 3:
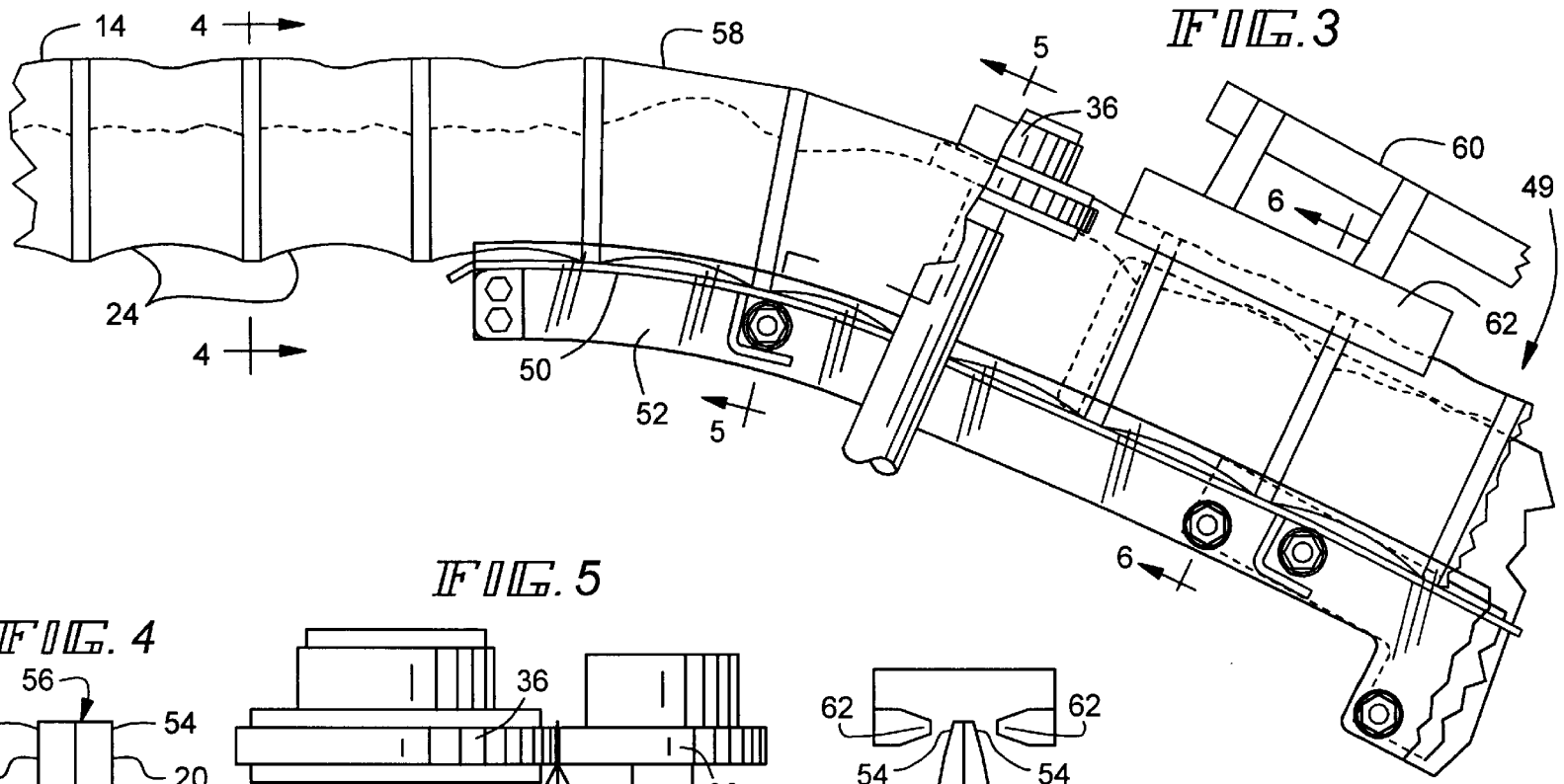
FIG. 3 is an elevated view of an upper portion of the top sealer apparatus.
Figure 5:
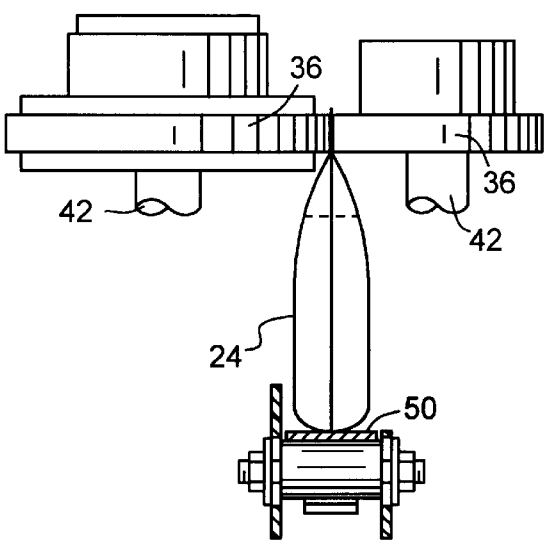
FIG. 5 is a section view taken along line 5—5 of FIG. 3.
Figure 4:
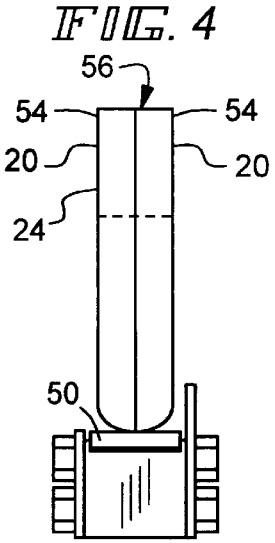
FIG. 4 is a section view taken along line 4—4 of FIG. 3.

Referring to FIGS. 3–5, as the pouch 24 enters the top seal forming apparatus 40 each of the linked pouches 24 are maintained in a loose configuration prior to moving the continuous web 14 along the arcuately shaped path 49. The loose configuration, shown in FIG. 4 with upper portions 54 of confronting sides 20 spaced apart to form a top opening 56, is maintained by the upper set of nip rollers 36 which operatively engage the continuous web 14, as shown in FIG. 5, and absorb and/or control downstream tensions on the continuous web 14 to maintain each of the linked pouches in the loose configuration. By keeping the web 14 loose, it is also possible to put more material in to the pouch 24 without having web stresses force the material out through the top opening 56. As the pouches start down the arcuately shaped path 49, the bottom of the bag is maintained loose while pulling the top of the pouch closed, which causes the upper portion of the pouch to have a greater width than the bottom, as shown at numeral 58 of FIG. 3. Once closed, the web 14 of pouches passes through the upper set of nip rollers 36, as best illustrated in FIG. 5 which also shows the bottom of the pouch being supported while it is dragged across the pouch support surface 50.

With respect to the widths of the pouch 24, it should be noted that the pouch width is reduced as the pouch 24 moves from the filling station 30 to the top seal forming apparatus 40. Once the pouches 24 are moved downwardly across the arcuately shaped path 49, the top width of the pouch 24 is increased as it is pulled. The increased top width relative to the bottom width is maintained between the first and second sets of nip rollers. For example, a pouch having 4¼" width would be maintained at a width of 3½" between the filling station 30 and the top seal forming apparatus 40. After the start of the arcuately shaped path, the top width of the pouch may have expanded to 4 17/64" with the bottom width still at 3½". After the first set of nip roller, but before the second set of nip rollers, described below, the top width of the pouch may be now 4 7/64" with the bottom width at 3⅞". It should be understood that the foregoing is intended for only illustrative purposes of the features and process described herein and that actual percentages and widths will vary based on desired pouch size, type and thickness of web material, and type and intended volume of fill material.

Figure 6:
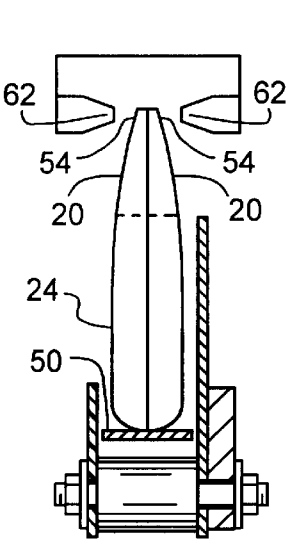
FIG. 6 is a section view taken along line 6—6 of FIG. 3.

Referring to FIGS. 3 and 6, a web heating unit 60 is positioned downstream from the first set of nip rollers 36 adjacent to the downwardly, arcuately shaped path 49 for heating the upper portion of the continuous web 14. As shown in FIG. 6, hot air top sealer jaws 62 of conventional design are positioned adjacent with the upper portions of the confronting sides 20 of the pouch to heat the sides 20 having sealant in preparation to forming a top seal.

According to other important features of our invention, a lower or second set of nip rollers 64 (FIGS. 7 and 9) are positioned at a lower portion 66 of the downwardly, arcuately shaped path 49 downstream from the web heating unit 60 for pulling said continuous web 14 and pinching the upper portions of the continuous web 14 to form a top seal 68 (FIG. 10) to enclose each of the linked pouches 24. During the step of forming the top seal portion, the continuous web 14 is moved through a sharper bend at an angle greater than that of the downwardly, arcuately shaped path 49 causing the open top of each pouch 24 to close while simultaneously passing through the lower set of nip rollers 64. Accordingly, both the lower set of nip rollers 64 and the sharper bend of web 14 act together simultaneously in the preferred embodiment to close the pouch. After the lower set of nip rollers 64, the filled pouches are consecutively disengaged from the pouch support surface 50 and thereafter engaged upon a lower second pouch support surface 51 which provides the sharper bend previously described.

Figure 10:
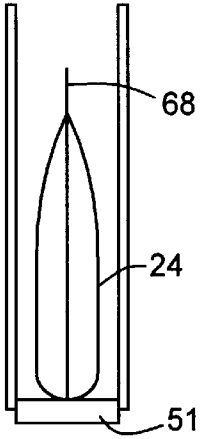
FIG. 10 is a section view taken along line 10—10 of FIG. 7.

Referring to FIG. 2, the lower set of nip rollers 64 is powered similarly as the first set of nip rollers 36. The lower set of nip rollers 64 are mounted to ends of shafts 66 (FIG. 9) of a second spindle assembly 68. The shafts 66 are connected to a spindle drive 70 which is a conventional servo motor that has a speed control 72 that can be independently controlled by a user. In the preferred embodiment shown, the speed controls 48, 72 are operated at slightly different speeds from one another. In particular, the second or lower set of nip rollers 64 is operated at speed greater than the first set of nip rollers 36 to maintain proper web 14 tension and assist in causing the open topped linked pouches 24 to close preparatory to forming the top seal 68 (FIG. 10).

As the continuous web of maximum volume filled pouches exits the vacuum transfer wheel, the web is engaged by the firs of two sets of independently driven and controlled top seal nip feed rollers. This first set pulls the web from the transfer wheel at a rate similar to that of the transfer wheel (linear inches/minute) to maintain the reduced center of the pouch at the bottom as well as the top, then the web, as it enters this first feed nip station, traverses over an arced surface to gently stretch the top flat while maintaining the reduced bottom centers (it is not sealed at this point).

The web then exits the first feed nip, still supported by a very slightly downward arced ramp, and pulled by the second feed nip rollers at a speed only slightly more than (one to one and a half percent overdrive) the first nip, thereby maintaining the reduced centers, unsealed, of the top seal area and bottoms. As the partially opened (top) web of pouches enters the second feed, another more extreme arc is traversed thus again gently closing the top seal area which has now been heated and is hermetically sealed without snapping or otherwise forcing product upward into that top seal area.

By careful maneuvering of the linked filled pouches the top open ends of the pouches can be delicately closed without disturbing the pouch bottoms so that powder will not be driven out of the open end of the pouches during the sealing of the open pouch ends.

Figure 9:
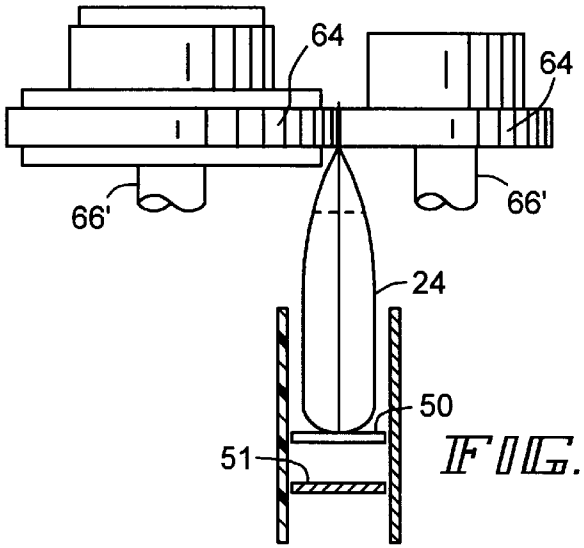
FIG. 9 is a section view taken along line 9—9 of FIG. 7.

Other known machines have only one set of nip feed draw rollers (called second feed rollers), positioned well after the top seal heaters. In this application we have them before and after the top seal heater. The filler wheel 34 pulls the web 14 through the machine in this particular embodiment of our inventions but, if desired, other components or our machine could be used to provide this function. The first set of nip rollers work with its associated speed control 48 to control the speed of the web in relationship to the speed of the second nip to maintain reduced centers on extremely full packages of powder. Any other known method has the effect of pulling the top and the bottom of the package to their original repeat length thus forcing product up and out into the top seal area, preventing the machine from producing good hermetic heat seals. It will further be in FIG. 2 that the upper level of the powder 32 varies during the progression of the pouches through the top sealer as seen in FIG. 2. The top or upper level of the powder 32 changes as the pouches move downwardly along the arcuate path such as at the drop off point where the pouches drop from the pouch support surface 50 (FIG. 3) to the lower second support surface 51 (FIG. 9).

Figures 7, 8:
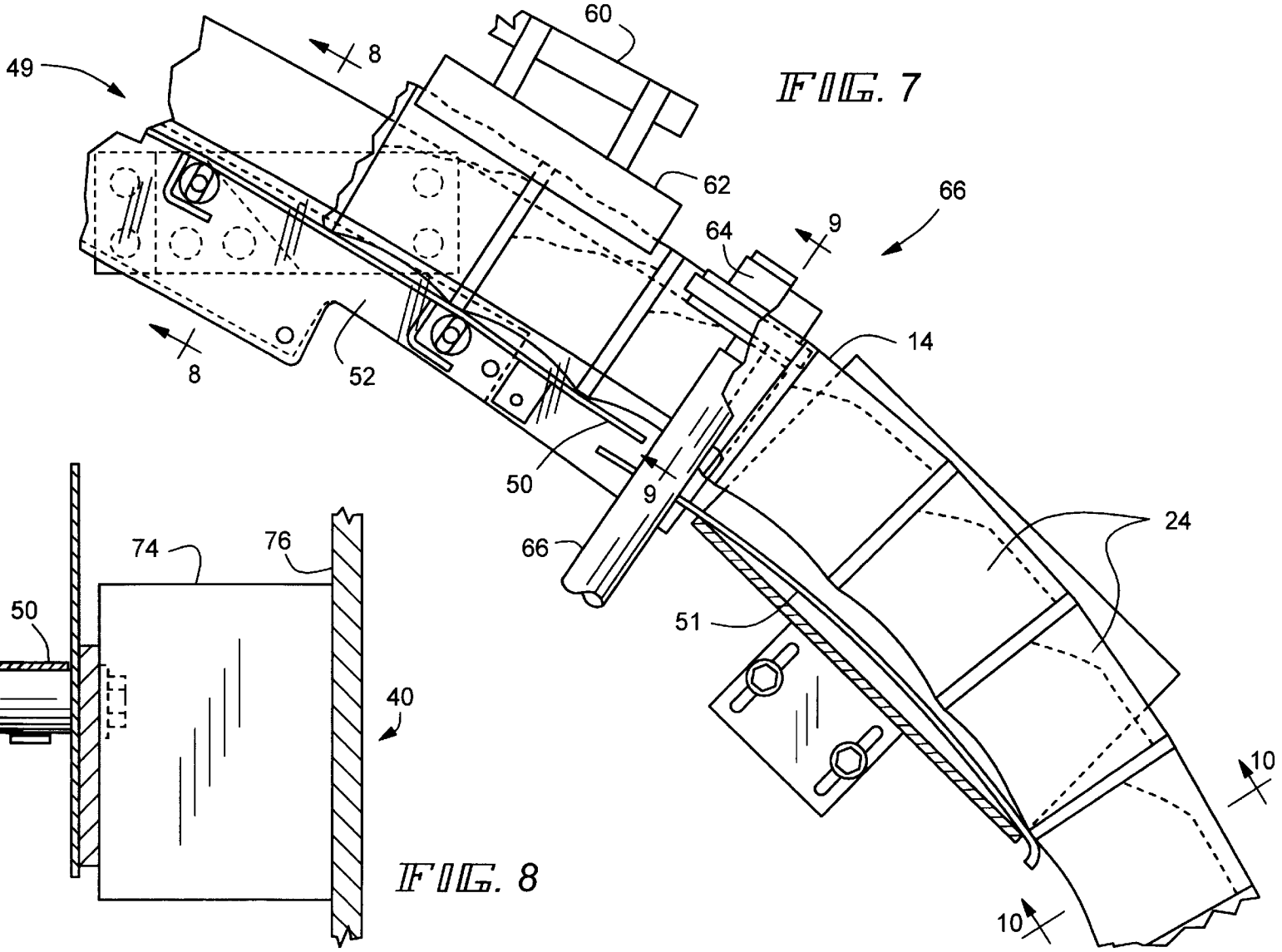
FIG. 7 is an elevated view of a lower portion of the top sealer apparatus.
FIG. 8 is a section view taken along line 8—8 of FIG. 7.

Referring to FIG. 8, the pouch support surface 50 is connected to a mounting block 74 which is connected to a wall 76 of the apparatus 40. While this is not necessary to perform the features of the present invention, the use of a mounting block 74 and the other adjustment assemblies as shown or described herein facilitates easy adjustment of the machine 10 where the same machine 10 will be used by a user at different times to produce pouches of varied size or having varied fill.

Referring back to FIG. 2, the web heating unit 60 is positionable in an operating position as shown for heating the upper portion of the continuous web 14 and is positionable to a safety position, indicated by arrow 78, with the web heating unit 60', indicated diagrammatically, positioned remote from said continuous web 14. The web heating unit 60 is attached to a pivot arm device or structure 80 having parallel arms 82 that pivot from opposite ends 84 with one end 84 of each arm 84 attached to a support arm 86 holding a series of hot air top sealer jaws 62 or other known web heating device and the other end 84 pivotally connected to the apparatus 40. An actuator 88 is connected therebetween the pivot arm device 80 and the apparatus 40 for moving the web heating unit 60 between the operating and safety positions. In a preferred embodiment, the actuator is an air cylinder controlled in a conventional manner. A counter weight 89 is attached to the pivot arms 82 for moving the jaws 62 to the safety position during an emergency condition, such an E-stop condition where the web 14 is not moving or in the event of a power loss.

In the preferred embodiment shown in FIG. 2, three sets of hot air top sealer jaws 62 are shown. However, it should be understood that the number of such heating mechanisms or type thereof may depend on the type of web material being used, the speed of the web, and the type of fill. To allow proper positioning of the jaws 62 relative to the upper portion of the web 14, the curved pouch support 50 and jaws 62 are substantially concentric with one another.

Referring back to FIG. 1, after the pouches 24 leave the top seal forming apparatus 40, the web is rotated 90° and the sealed pouches 24 are moved on a conveyor through a pouch leveling station 90 of conventional type where pounding rods 91 are used to smooth the product within the pouches 24. However, it should be understood that this step may or may not be desired depending on the type of packaging application.

Thereafter, the web 14 is moved to a pouch severing station 92 to successively sever each leading powder filled sealed package from the continuous linked strip or web of powder filled sealed packages to free the packages 12 from the web 14. As shown in FIG. 1, a drum cutting device 94, rotated by a motor 95, is used to sever the pouches 24 from the web 14 with blades 96.

Although the invention has been described by reference to some embodiments it is not intended that the novel device be limited thereby, but that modifications thereof are intended to be included as falling within the broad scope and spirit of the foregoing disclosure, the following claims and the appended drawings.

SUMMARY DESCRIPTION OF OPERATION

Prior to our invention unsuccessful efforts were made to use old equipment to package powder on a horizontal type packaging machine. This old equipment employed a top seal heater area that was followed by just one set of pinch rollers, that pulled the web, as it was released from the filler wheel, over a bottom guide arc. There was two to three feet of web, between the point at which it was released from the filler wheel to the point at which it was pulled by the pinch rollers. As a result, every time a pouch was released from the vacuum lands on the filler wheel, that pouch would snap closed, because the two to three feet of web between that point and the pinch rollers was under tension, and there was no way to control the release of the pouch from the filler wheel, and no way to control the tension of that pouch as it was released. Snapping the pouches closed, in cases where the fill was fairly high, resulted in ejecting powder from the top of the pouches creating very unsatisfactory results.

Only after many months, were we able to solve those problems as described before herein After experimentation, we found that when we placed a second set of pinch rollers up close to the filler wheel and provided independently operated controls on each set of nip rollers on a top sealer section that we could then control the web coming off of the filler wheel, so that as it was released from the filler wheel, we would apply very little or no tension to that short string of pouches. We were then able to prevent the product from being forced out of the top of the pouch thus accomplishing an important goal. We then we needed to close the pouch in such a way that the product in the pouch would be undisturbed. We accomplished that by arcing the bottom guide and, as a result, also arcing the web that would follow the bottom guide, in such a manner that the top seal area of the pouch would pull tight and the bottom area of the pouch, the bottom cord, would not be changed substantially from the cord that was set on the filler wheel. For instance, on the filler wheel, the center between the lands is reduced to create an open pouch that we can drop product into. If we avoid disturbing the bottom cord at all, and just simply pull the top of the pouch closed, the string of pouches in that form will create an arc. If you can picture having the bottom cord at some percentage less than the top cord, you then create an image of a string of trapezoids that form an arc. That arc that the pouch naturally wants to follow when we have the reduced center at the bottom and the pulled tight center at the top, is the arc that we put into the bottom guide just prior to the first set of pinch rollers.

After the first set of pinch rollers 36, the arc is much less severe. We make a larger radius arc that blends in with that first arc. If we were to continue with the first arc beyond the first set of pinch rollers and through the entire length that we need for the heater, the pouches would swing toward the floor much to rapidly, and as a result the product would spill from the top of the pouch. So we are not only trying to prevent forcing the product out of the top of the pouch but we are also trying to prevent spilling it. We have a less severe arc or a larger radius arc between the first set of rollers and the second set of rollers. Just prior to the second set of rollers 64, just after the heating area, we then go into another arc change which results in an almost complete closure of the pouch just prior to the second set of pinch rollers which close the top of the pouch off and through the pressure of the pinch rollers they seal it shut.

One important feature of the first and second set of pinch rollers, is that they can be controlled in speed independent of one another so that we not only control the web as it is released from the filler wheel by adjusting the speed of the first set of rollers, but then we also control the tension of the web between the two as it is being heated so that we pull the pouch almost closed before the second set of pinch rollers. If we have too much tension, by over-speeding the second set of feed rollers too much, we will end up again disturbing the product in the pouch and pushing the product out of the top of the pouch. If we do not have enough tension, the pouches will be too wide open when they hit the second set of pinch rollers which results in too rapid of a closing due to the pinch rollers. So, being able to control the speed of the two sets of rollers independently is very important, and can be adjusted from job to job as required.

The web heating unit 60 has its lift mechanism which includes the pivot arm lift mechanism provided to raise the web heater unit away from the web in the event that the web stops moving. This is to prevent fires and also to prevent people from having to put their hands too close to the hot bars or jaws 62 when they are threading the web through the bottom guide. This could be any type of lift mechanism. The type that we used with the parallel arms and counter-weights is one type of mechanism that can be used to accomplish this result.

The slides and the mounts for the spindles hold the pinch rollers allow for complete adjustability. We can put the rollers 36 and 64 in a wide range of positions and at a wide range of angles to accommodate different arcs, different web sizes, different lengths of heaters, etc. In addition, the arcuate bottom guide can be removed in one piece and replaced with a bottom guide having a different arc for different fills. Again, different pouches with different fills, can be run by simply replacing the arcuate guides and by readjusting the pinch roller positions at 36 and 64.

We claim:

1. Method of continuously forming a top seal on a continuous web of linked pouches having an open top and material filled therewithin each linked pouch, the method comprising the steps of:

moving the continuous web along a downwardly, arcuately shaped path while maintaining web tension prior to and during heat sealing;

heating a top seal portion of each of the linked pouches as the continuous web moves along a central portion of the downwardly, arcuately shaped path; and sealing the top seal portion of each of linked pouches at a lower portion of the downwardly, arcuately shaped path to enclose each of the linked pouches.

2. The method of claim 1, further comprising the step of maintaining each of the linked pouches in a loose configuration prior to moving the continuous web along the arcuately shaped path.

3. The method of claim 2, wherein the step of maintaining each of the linked pouches in a loose configuration includes the step of providing an upper set of nip rollers at an upper portion of the downwardly, arcuately shaped path to operatively engage the continuous web and absorb and/or control downstream tensions on the continuous web to maintain each of the linked pouches in the loose configuration.

4. The method of claim 3, wherein the step of sealing the top seal portion includes the step of providing a set of lower nip rollers to press the top seal portion together as the continuous web of linked pouches passes between the set of lower nip rollers.

5. The method of claim 4, wherein the step of sealing the top seal portion further comprises the step of downwardly moving the continuous web at an angle greater than that of the downwardly, arcuately shaped path to close the open top of each pouch while simultaneously passing through the set of lower nip rollers.

6. The method of claim 5, wherein the continuous web is moved at a rate of 300 to 2,500 pouches per minute depending upon repeat length and product flowability.

7. A top seal forming apparatus for a continuously moving continuous web of filled open topped linked pouches formed of heat sealable material, the apparatus comprising:

means for moving said continuous web along a downwardly, arcuately shaped path;

a first set of nip rollers positioned at an upper portion of the downwardly, arcuately shaped path, the first set of nip rollers adapted for operatively engaging an upper portion of the continuous web;

a web heating unit positioned downstream from the first set of nip rollers adjacent to the downwardly, arcuately shaped path for heating the upper portion of the continuous web; and a second set of nip rollers positioned at a lower portion of the downwardly, arcuately shaped path downstream from said web heating unit for pulling said continuous web and pinching the upper portions of the continuous web to form a top seal to enclose each of the linked pouches.

8. The apparatus of claim 7, wherein the web heating unit is positionable in an operating position for heating the upper portion of the continuous web and a safety position with the web heating unit positioned remote from said continuous web.

9. The apparatus of claim 8, wherein the web heating unit includes a pivot arm device for moving the web heating unit between the operating and safety positions.

10. The apparatus of claim 8, wherein the web heating unit includes hot air top sealer jaws, a pivot arm structure connected to the hot air top sealer jaws, an actuator operatively connected to the pivot arms for moving the hot air top sealer jaws between operating and safety positions.

11. The apparatus of claim 10, further comprising a counter weight operatively attached to the pivot arms for moving the hot air top sealer to the safety position during an emergency condition.

12. The apparatus of claim 7, wherein the first and second set of nip rollers are connected to drives independently controlled from one another.

13. The apparatus of claim 12, wherein the first and second set of nip rollers are operated at slightly different speeds from one another.

14. The apparatus of claim 13, wherein the second set of nip rollers is operated at speed greater than the first set of nip rollers causing the open topped linked pouches to close preparatory to forming the top seal.

15. The apparatus of claim 7, wherein the linked pouches are filled with powder material.

16. The apparatus of claim 7, further comprising means for supporting the bottom portion of continuous web during a substantial portion as it is moved along the downwardly, arcuately shaped path.

17. Method of packaging powder material comprising the steps of:

continuously feeding a V-shaped web of heat sealable packaging material to a first forming station;

forming longitudinally spaced upright seals at the first forming station to provide longitudinally spaced upwardly opening pouches, thereafter consecutively filling the pouches on the V-shaped web with powder material at a filling station using a first set of powered nip rollers to pull the V-shaped web from the filling station;

pulling the linked filled pouches with a second set of powered nip rollers operating at a speed slightly greater than the first pair of powered nip rollers through a downwardly curving path to lengthen a width of upper ends of each filled pouch while dragging the filled pouch along a curved pouch support surface engaged with a bottom end of each pouch, closing the open ends of the filled pouches, heat sealing an upper open end of each filled pouch to form a continuous linked strip of powder filled sealed packages; and successively severing each leading powder filled sealed package from the continuous linked strip of powder filled sealed packages to free the sealed powder filled packages from the strip.

18. The method of claim 17, wherein the filled pouches are consecutively disengaged from the pouch support surface and thereafter engaged upon a lower second pouch support surface.

19. The method of claim 18, wherein the continuous linked strip of powder filled sealed packages are produced at rate of 300 to 2,500 sealed powder filled packages per minute depending upon repeat length and product flowability with each sealed powder filled package of a same size and weight.

20. The method of claim 17, wherein the powder material is comprised of a food product.

21. The method of claim 17, wherein the powder material is comprised of a non-food product.

22. The method of claim 17, wherein the rates of speed of the first and second sets of powered nip rollers are separately controlled.

23. The method of claim 17, wherein the pouch support surface is held stationary as the filled pouches are dragged along the pouch support surface by the second set of powered nip rollers.

24. The method of claim 17, wherein the V-shaped web is comprised of a single continuous length having a closed bottom.

25. In an apparatus for packaging powder material from a continuously moving V-strip of heat sealable packaging material having linked filled heat sealed pouches drawn by a first set of nip rollers operating at a preselected speed, the improvement comprising:

a top sealer mechanism including a heat sealer device for forming top seals on the linked filled heat sealed pouches;

a first curved support surface underlying the top sealer mechanism;

a second set of nip rollers rotating at a speed greater than said first set of nip rollers positioned relative to said heat sealer device to close upper ends of the linked filled heat sealed pouches while dragging in supported relation on the first curved support surface; and the heat sealer device being positioned to the upper ends of the linked filled heat sealed pouches as the pouches travel a downwardly curved path along said curved support surface.

26. The apparatus of claim 25, wherein separate controls are provided for said first and second sets of nip rollers to enable speed control of each relative to one another with the second set of nip rollers at all times being operated at a greater speed than the first set of nip rollers.

27. Method of continuously forming, filling and sealing packages of powder material with a continuous web of heat sealable film material, the method comprising the steps of:

providing the web of heat sealable film material;

folding the web to provide confronting sides joined along a bottom edge;

forming longitudinally spaced vertical seals to form pouches having an open top;

filling the pouches;

sealing the filled pouches to enclose the filled pouches by: maintaining each of the filled pouches in a loose configuration prior to moving the continuous web along a downwardly, arcuately shaped path; supporting a bottom portion of the filled pouches with during a substantial portion of the downwardly, arcuately shaped path; heating a top portion of the confronting sides of each of the filled pouches as the web moves along a central portion of the downwardly, arcuately shaped path; and sealing the top portion of the confronting sides of each of filled pouches at a lower portion of the downwardly, arcuately shaped path by pressing the heated top portions of the confronting sides together; and successively severing each leading sealed pouch from the web to form a separate sealed package of powder material.

28. The method of claim 27, wherein the step of maintaining each of the filled pouches in a loose configuration includes the step of providing an upper set of nip rollers at an upper portion of the downwardly, arcuately shaped path to operatively engage the web and absorb and/or control downstream tensions on the web to maintain each of the filled pouches in the loose configuration.

29. The method of claim 28, wherein the step of sealing the top portion includes the step of providing a set of lower nip rollers to press the top portion of the confronting sides together as the web of linked filled pouches passes therebetween the set of lower nip rollers.

30. A packaging apparatus for powder material comprising:

means for feeding a continuous web of heat sealable film material having confronting sides joined along a bottom edge;

means for forming longitudinally spaced vertical seals to form pouches having an open top;

a filling station for filling the pouches;

a curved pouch support surface for supporting bottom portions of the filled pouches each in an undisturbed position as the pouches are moved along a downwardly, arcuately shaped path for sealing upper open ends of the pouches;

a first set of nip rollers positioned at an upper portion of the downwardly, arcuately shaped path, the first set of nip rollers adapted for operatively engaging an upper portion of the web;

a web heating unit positioned downstream from the first set of nip rollers adjacent to the downwardly, arcuately shaped path for heating the upper portion of the web; and a second set of nip rollers positioned at a lower portion of the downwardly, arcuately shaped path downstream from said web heating unit for pulling said continuous web and pinching the upper portions of the continuous web to form a top seal; and means for severing each leading sealed pouch from the web to form a separate sealed package of powder material.

31. The apparatus of claim 30, wherein the web heating unit is positionable in an operating position for heating the upper portion of the web and a safety position with the web heating unit positioned remote from said web.

32. The apparatus of claim 31, wherein the web heating unit includes a pivot arm device for moving the web heating unit between the operating and safety positions.

33. The apparatus of claim 31, wherein the web heating unit includes hot air top sealer jaws, a pivot arm structure connected to the hot air top sealer jaws, and an actuator operatively connected to the pivot arms for moving the hot air top sealer jaws between operating and safety positions.

34. The apparatus of claim 33, further comprising a counter weight attached to operatively attached to the pivot arms for moving the hot air top sealer to the safety position during an emergency condition.

35. The apparatus of claim 30, wherein the first and second set of nip rollers are connected drives independently controlled from one another.

36. The apparatus of claim 35, wherein the first and second set of nip rollers are operated at different speeds from one another.

37. The apparatus of claim 36, wherein the second set of nip rollers is operated at speed greater than the first set of nip rollers causing the open topped pouches to close preparatory to forming the top seal.

38. The apparatus of claim 33, wherein the curved pouch support and hot air top sealer jaws are substantially concentric with one another.

39. Method of continuously forming a top seal on a continuous web of linked pouches having an open top and material filled therewithin each linked pouch, the method comprising the steps of:

moving the continuous web to maintain linked pouches having a reduced width;

moving the continuous web along a downwardly, arcuately shaped path to increase the width of an upper portion of the linked pouches;

providing an upper set of nip rollers at an upper portion of the downwardly, arcuately shaped path to operatively engage the continuous web;

heating a top seal portion of each of the linked pouches as the continuous web moves at a decreased downward angle along a central portion of the downwardly, arcuately shaped path; and sealing the top seal portion of each of linked pouches with a lower set of nip rollers positioned at a lower portion of the downwardly, arcuately shaped path while simultaneously moving the continuous web at an increased downward angle to cause the open top of each linked pouch to close preparatory to sealing.

40. The Method of claim 39 wherein the second set of rollers operates at a greater speed than the first set of rollers which sets of rollers are controlled independently of one another.

41. Method of continuously forming a top seal on a continuous web of linked pouches having an open top and material filled therewithin each linked pouch, the method comprising the steps of:

moving the continuous web to maintain linked pouches having a reduced width by controlling web tension prior to and through the top sealer moving the continuous web along a downwardly, arcuately shaped path to increase the width of an upper portion of the linked pouches:

providing an upper set of nip rollers at an upper portion of the downwardly, arcuately shaped path to operatively engage the continuous web;

heating a top seal portion of each of the linked pouches as the continuous web moves along a central portion of the downwardly, arcuately shaped path; and sealing the top seal portion of each of linked pouches with a lower set of nip rollers positioned at a lower portion of the downwardly, arcuately shaped path while simultaneously moving the continuous web at an increased downward angle to cause the open top of each linked pouch to close preparatory to sealing.

42. The Method of claim 41 wherein the second set of rollers operates at a greater speed than the first set of rollers which sets of rollers are controlled independently of one another.

43. The method of claim 41 wherein the bottoms of the linked pouches are supported from beneath leaving the filled material in an undisturbed condition as the web is moved along the downwardly, arcuately shaped path to avoid discharge of the filled material from the open ends of the pouches during the heating of the top seal portions preparatory to sealing by the lower set of nip rollers.

44. The method of claim 41 further including the step of arcing the bottoms of the linked pouches while supporting the pouch bottom leaving the filled material undisturbed in the pouches while heating the top seal portions prior to sealing.

* * * * *